US005775789A

United States Patent [19]

Rainey et al.

[11] Patent Number: 5,775,789

[45] Date of Patent: Jul. 7, 1998

[54] UNIVERSAL CONTAINER SLIDE FOR A REACH-IN CABINET

[75] Inventors: Jerry Rainey, Tyrone; Donald Dunn, Senoya, both of Ga.

[73] Assignee: Hoshizaki America, Inc., Peachtree City, Ga.

[21] Appl. No.: 595,174

[22] Filed: Feb. 1, 1996

[51] Int. Cl.[6] ..... A47B 9/00

[52] U.S. Cl. ..... 312/408; 108/107

[58] Field of Search ..... 312/334.23, 408; 108/96, 97, 93, 107, 192

[56] References Cited

U.S. PATENT DOCUMENTS

| | | | |
|---|---|---|---|
| 2,479,858 | 8/1949 | Nauert . | |
| 2,582,038 | 1/1952 | Jewell | 312/408 |
| 2,801,146 | 7/1957 | Mikulas | 312/334.23 |
| 2,815,649 | 12/1957 | Di Angelus | 312/408 |
| 3,994,462 | 11/1976 | Shine . | |
| 4,089,276 | 5/1978 | Enos . | |
| 4,109,961 | 8/1978 | Opsvik | 108/96 |
| 4,183,488 | 1/1980 | Shepard . | |
| 4,185,566 | 1/1980 | Adams . | |
| 4,934,642 | 6/1990 | Baron et al. . | |
| 5,020,758 | 6/1991 | Rawlyk . | |

OTHER PUBLICATIONS

Hobart Food Equipment, "Refrigeration Capacity Chart", Wold Headquarters, Troy, Ohio.

*Primary Examiner*—Peter M. Cuomo
*Assistant Examiner*—Gerald A. Anderson
*Attorney, Agent, or Firm*—Nikaido, Marmelstein, Murray & Oram LLP

[57] ABSTRACT

A refrigerated cabinet includes first and second inner side walls therein, and a rear wall disposed at a rear portion of the cabinet. A pair of first container supports is provided for the cabinet, with each of the first container supports being mounted on the first and second inner side walls of the cabinet. The pair of first container supports are configured to engage and support a container of a first size therebetween. A pair of second container supports are provided, and are attached to the pair of first container supports. The pair of second container supports are configured to support a second container thereupon, with the second container being of a second size which has a larger width than the first container.

7 Claims, 4 Drawing Sheets

UNIVERSAL CONTAINER SLIDE FOR A REACH-IN CABINET

BACKGROUND OF THE INVENTION

1. Field of the Invention:

The invention is directed to a reach-in universal container slide which can be used in a reach-in cabinet, and a reach-in cabinet having such a container slide. A cabinet having the container slide is provided with a simple to manufacture and easy to use structure for storing various sizes of standardized food containers which are used in the hotel and restaurant industries.

2. Description of the Related Art:

It is known in the art to provide a refrigerated cabinet with a series of shelves, or a series of engagement points on the sides of the cabinet, to allow a single size shelf, pan, container or drawer to be slid therein. If a narrower drawer or shelf was sought to be used, however, it would merely sit on top of the standard size drawer or shelf, resulting in an ineffective use of space within the refrigerator or refrigerated cabinet.

SUMMARY OF THE INVENTION

The present invention, therefore, is directed to a reach-in refrigerated cabinet wherein first and second container or tray supports are provided in a manner which allows two different size containers to be attached thereto, without unnecessarily utilizing a standard size shelf. The invention includes a first pair of container supports configured to be disposed in a reach-in cabinet; each of the first pair of container supports are mounted on pilasters or engagement elements on opposite sides of the cabinet, and are configured to engage and support a first container of a first size therebetween. A second pair of container supports are disposed inside of the cabinet; this second pair of container supports are integral with the first pair of container supports, and are configured to support a second container thereupon. The second container is of a second size which is larger than the first container. The configuration can be provided by the first pair of container supports having a triangular cross-section, with the triangular cross-section being such that a bottom portion of the triangular shape provides a bracing function for the support of the first tray, and also provides surface upon which to form or mount the second container support.

In further embodiments of the invention, the second pair of container supports can be of a variable size and/or at a variable location to fit a number of sizes of second containers. A goal of the invention, however, is that the first pair of container supports is configured to accommodate a first container of a standardized first size, and the second pair of container supports being configured to accommodate a second container of a second standard size.

The first pair of container supports can be integrally molded or permanently attached to the inner walls of the cabinet, or can be engaged and disengaged from shelf supports which are disposed on the inner walls of the cabinet. A further aspect of the invention includes a wire-form stop element to prevent damage to the interior of the reach-in cabinet by the impact of trays or pans. The stop element attaches to the pan slide device.

BRIEF DESCRIPTION OF THE DRAWINGS

The above advantages and overall configuration of the present invention will be apparent upon review of the present specification and the accompanying drawings, wherein.

DETAILED DESCRIPTION OF THE PREFERRED EMBODIMENT

Figure 1:
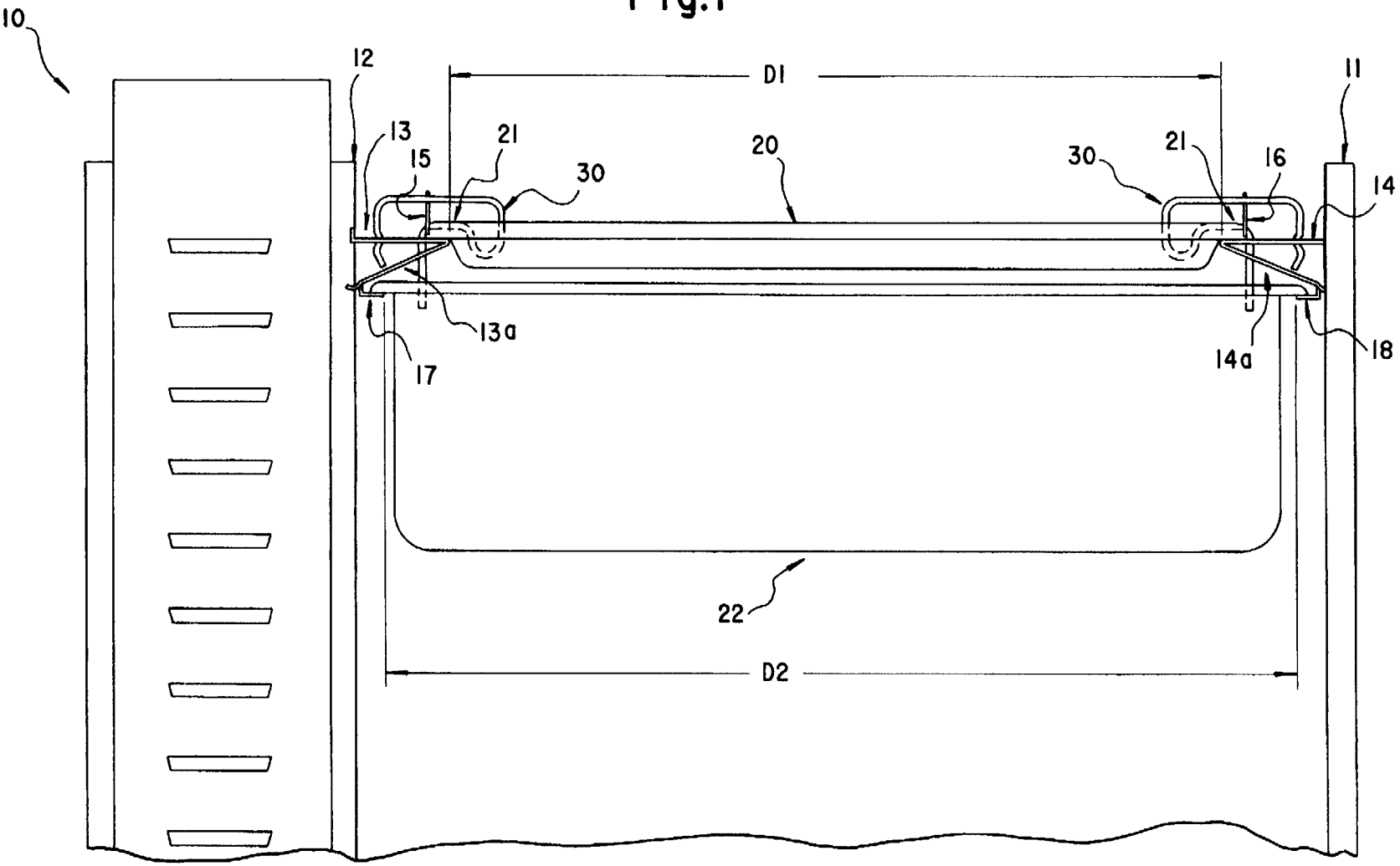
FIG. 1 is a front view of a portion of the universal container slide according to the present invention.
Figure 2:
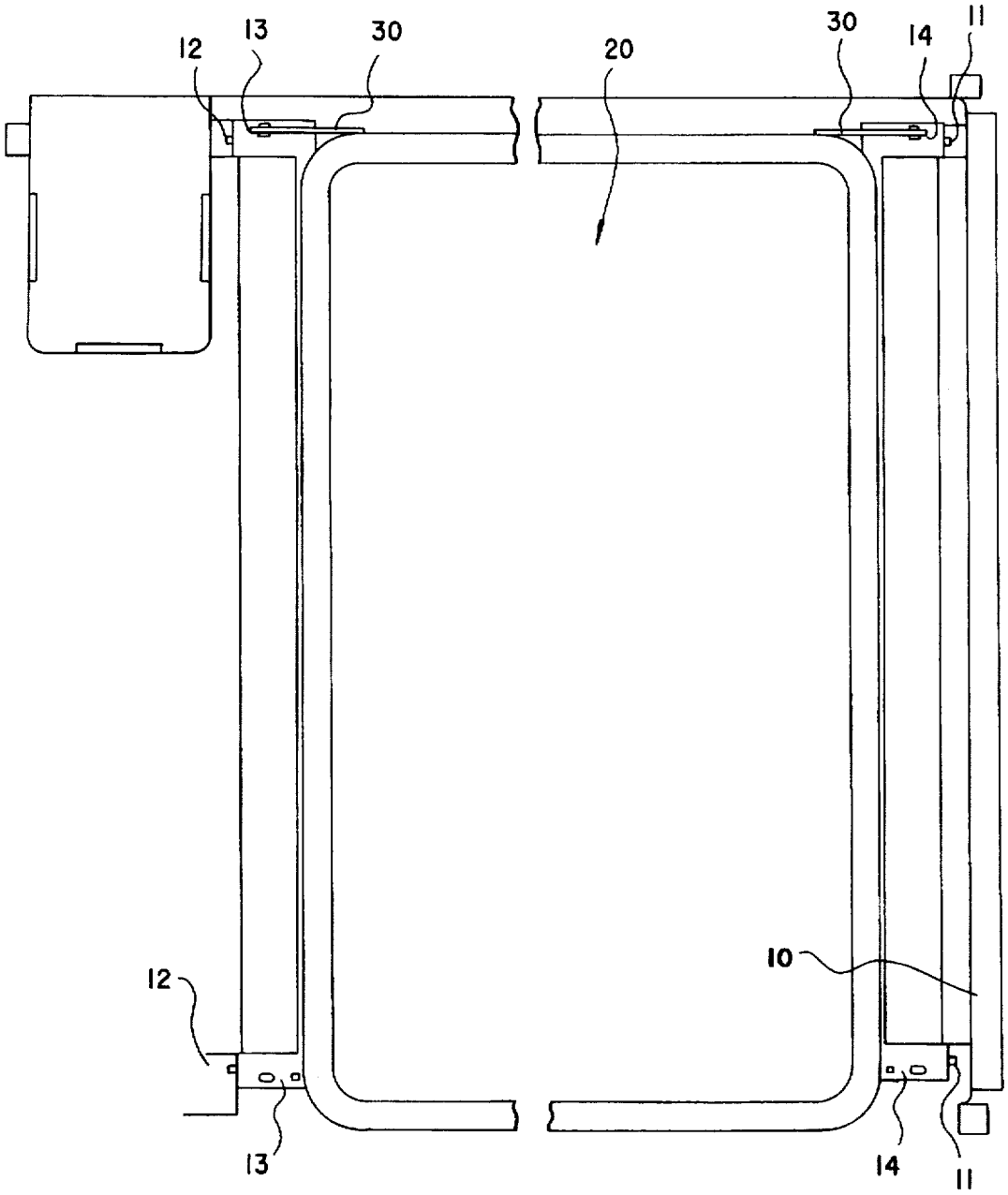
FIG. 2 is a top view of a container and a universal container slide according to the present invention.
Figure 3:
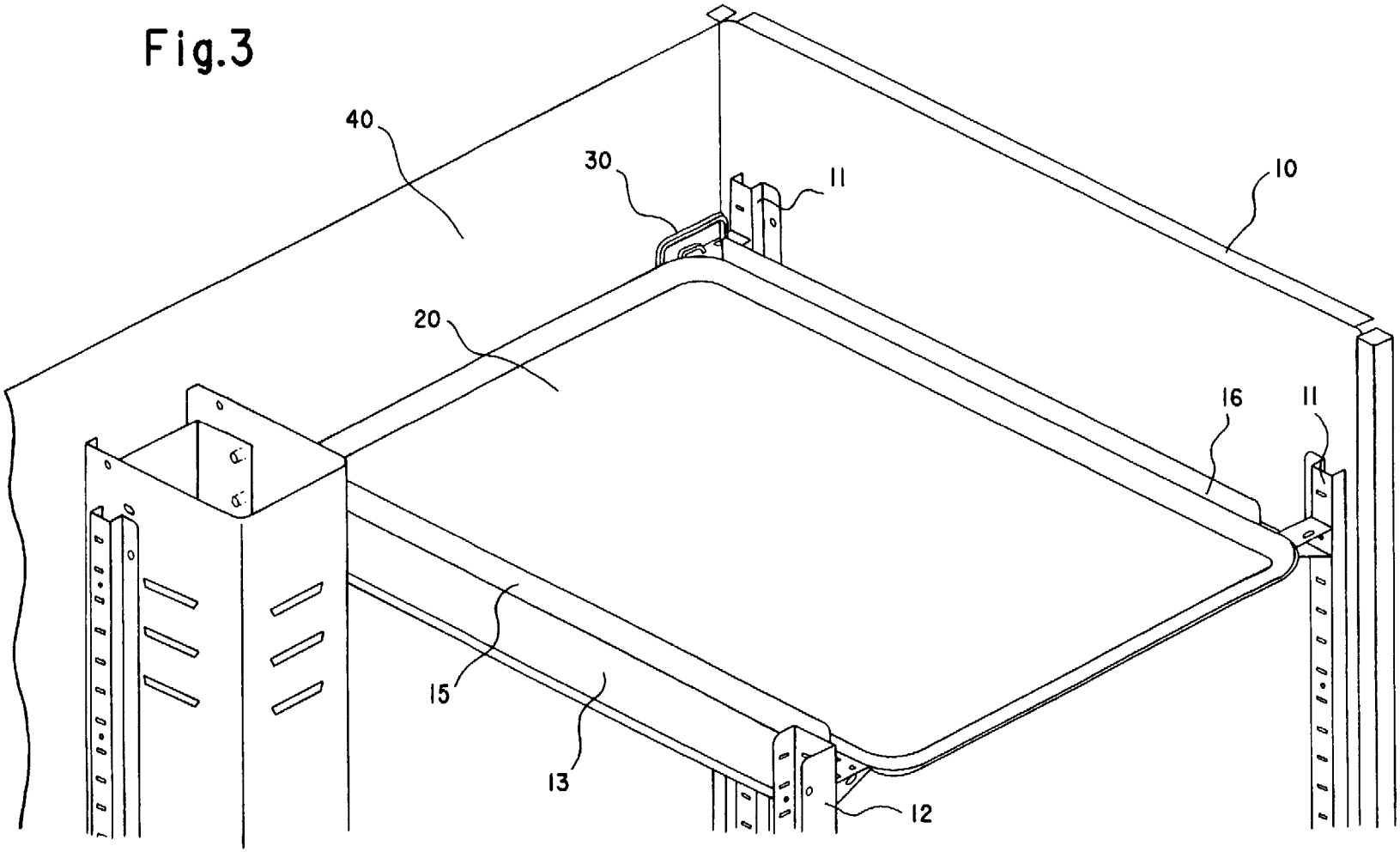
FIG. 3 is a perspective view of an interior of a cabinet employing a universal container slide according to the present invention.
Figure 4:
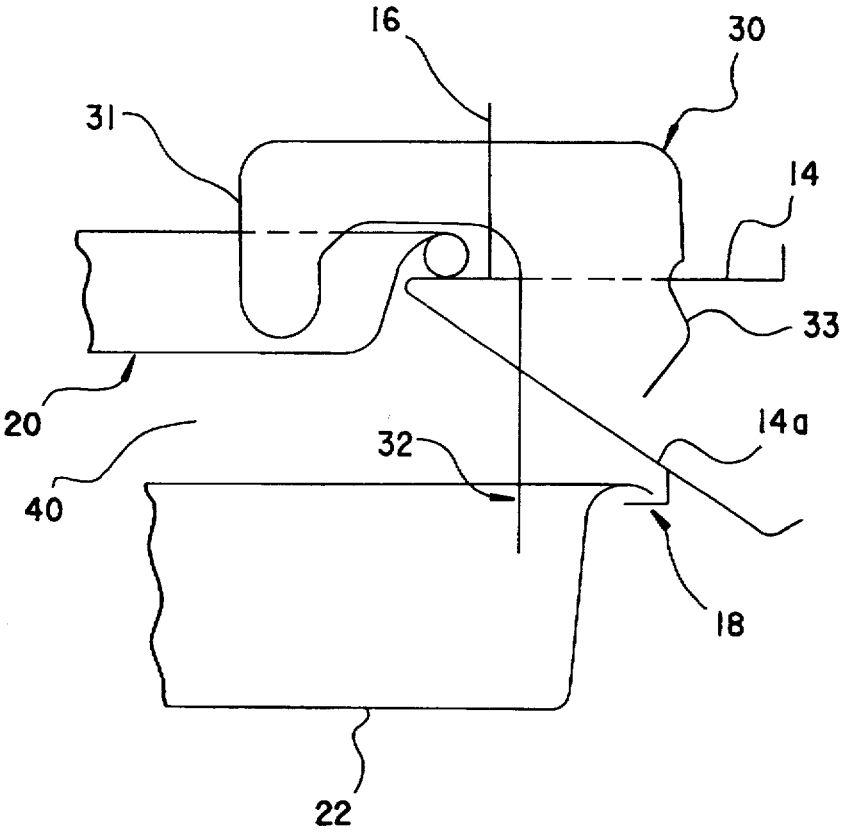
FIG. 4 is a partial view of the first and second container supports of the invention, along with a stop element at a rear portion of the cabinet.

Referring to FIGS. 1–3, refrigerated cabinet 10 includes support members 11 and 12 therein. Also within refrigerated cabinet 10 are container supports 13 and 14, which attach to support members 11 and 12, respectively. Container supports 13 and 14 project inward, and are configured to support a first container 20 thereupon. Container supports 13 and 14 can be engaged and disengaged from support members 11 and 12 which are attached to or molded with the sides of the cabinet. The engagement and disengagement occurs through the use of a cooperating engagement and disengagement means on container supports 13 and 14 and on support members 11 and 12. Container 20 includes edge portions 21, which rest against the inner portions of container supports 13 and 14 by the force of gravity. In order to prevent container 20 from undesirably sliding in a side to side manner, the container supports 13 and 14 can each be supplied with guide elements 15 and 16. Container supports 13 and 14, and guide elements 15 and 16, can be integrally formed with each other, or can be attached and assembled as separate components. Various combinations of integrally molded elements and separate components can be used. Typically, a refrigerated cabinet would be supplied with a plurality of container supports 13 and 14, for accompanying a plurality of containers thereupon.

Due to the limited space between the inner points or edges of container supports 13 and 14, any container which is larger in width than dimension D1 (see FIG. 1) would not fit therein. In order to accommodate containers 22 of a larger dimension D2, second container supports 17 and 18 are provided therein. Second container supports 17 and 18 are formed at the bottom or lower surface 13*a* and 14*a* of container supports 13 and 14, and project downward. A distance between these tray supports is sufficient to accommodate a container or shelf having a size of dimension D2. A height between second container 22 and first container 20 can be selected to allow for a necessary amount of space to allow adequate air circulation over the top of second container 22. The second container supports 17 and 18 can also be configured to be adjustable such that they are movable in a horizontal direction, to allow distance D2 to be varied.

The first container supports 13 and 14 are disclosed herein as having a triangular configuration; it should be understood, however, that it is within the scope of the invention to modify container supports 13 and 14 to have a different shape, based upon particular requirements of the application, or for aesthetic reasons.

Referring to FIGS. 1–4, a stop means or stop element 30 is attached at a rear of container supports 13 and 14, at the rear of cabinet 10. Stop element 30 includes a first surface 31 and a second surface 32, which are stopping surfaces for the first and second containers 20 and 22, respectively. As containers 20 and 22 are slid along their respective container supports, they could conceivably be slid with enough force so as to damage a rear wall of the refrigerated cabinet; refrigerated cabinets typically have soft plastic or composite surfaces due to the good insulating qualities inherent with such materials. Stop element 30, therefore, is configured such that a single stop element 30 can act as a bumper or a stopping element for containers 20 and 22. Surface 31 of stopping element 30 is disposed at a height so as to engage tray 20, and stopping surface 32 is disposed at a height so as to engage tray 22. The stopping element is configured to be attached to container support 13 or 14, through spring pressure provided by leg 33. Stop element 30 is configured from sheet metal or a wire, and is configured such as to provide a springing or shock absorbing action upon engagement or impact with the containers. A single stop element 30 can be attached to one of container supports 13 and 14, or each of container supports 13 and 14 can have a stop element 30 disposed thereupon.

The first and second container supports are configured so as to form a continuous guide or support from a front portion of the cabinet near an access opening thereof towards the rear of the cabinet where the stop element is located. A refrigerated cabinet according to the claimed invention can have the container supports integrally mounted thereto, or can be implemented in the form of first and second tray support pieces which can engage shelf supports in an existing refrigerator. The inventive configuration of the first and second container supports, when used or retrofitted into an existing refrigerator will provide the same advantage of maximizing efficiency within the refrigerator by allowing first and second container sizes to be effectively stored and supported therein. Stop elements 30 can also be added into an existing cabinet as a retrofit piece, in conjunction with the first and second container supports.

The first and second container supports can be formed of a number of materials, including plastic, metal, composites, or any combination thereof. The cross sections of the supports are not limited to the configurations disclosed in the drawings. The cross section, although currently shown as being triangular, could have an arcuate surface in cross section, oblong or elliptical cross section, or any other configuration which provides an appropriate bracing function for the first container support, and also provides a suitable means upon which to attach the second container supports.

It is noted that the scope of this invention is not limited to the specific embodiments discussed above. The scope of the invention is defined by the appended claims, and the equivalents thereof.

We claim:

1. A reach-in universal container slide, comprising:

a pair of first container supports, each first container support of said pair of first container supports configured to be mounted on opposite internal sides of a cabinet, said pair of first container supports including first innermost edges which are configured to engage and support a first container of a first size therebetween;

a pair of second container supports respectively attached to each of said first container supports, said pair of second container supports having second innermost edges which are configured to support a second container therebetween, said second container being of a second size which has a larger dimension than a dimension of said first container;

stop means disposed at a rear portion of at least one of the first container supports, said stop means for stopping rearward movement of each of the first and second containers, thereby preventing damage to an inner portion of the cabinet, said stop means further comprising a stop element for engaging said first container, and a second stop element for engaging said second container, said first and second stop elements being integral with each other, wherein said stop means includes attachment means for attaching the stop means to the rear portion of the at least one of the first container supports.

2. A reach-in universal container slide according to claim 1, wherein said second container supports are configured to support said second container at a position below said first container supports.

3. A reach-in universal container slide, comprising:

a pair of first container supports, each first container support of said pair of first container supports configured to be mounted on opposite internal sides of a cabinet, said pair of first container supports including first innermost edges which are configured to engage and support a first container of a first size therebetween;

a pair of second container supports respectively attached to each of said first container supports, said pair of second container supports having second innermost edges which are configured to support a second container therebetween, said second container being of a second size which has a larger dimension than a dimension of said first container;

stop means disposed at a rear portion of at least one of the first container supports, said stop means for stopping rearward movement of each of the first and second containers, thereby preventing damage to an inner portion of the cabinet, wherein said stop means comprises a pair of stop brackets, each stop bracket of said pair of stop brackets corresponding to one first container support of said pair of first container supports, said each stop bracket including a first stop element for engaging said first container, and a second stop element for engaging said second container.

4. A reach-in universal container slide according to claim 3, wherein said second container supports are configured to support said second container at a position below said first container supports.

5. A refrigerated cabinet, comprising:

first and second inner side walls;

a rear wall adjacent said first and second inner side walls;

first and second engagement means disposed upon said first and second inner side walls, respectively;

a pair of first container supports, each of said pair of first container supports being mounted on said first and second engagement means, respectively, said pair of first container supports being configured to support a container of a first size therebetween;

a pair of second container supports respectively attached to each of said first container supports, said pair of second container supports being configured to support a second container thereupon, said second container being of a second size which has a larger width than said first container; and stop means disposed at a rear of one of the first and second container supports, said stop means being configured to stop rearward movement of each of the first and second containers, thereby preventing damage to the rear wall, wherein said stop means comprises a pair of stop brackets, each stop bracket of said pair of stop brackets corresponding to one first container supports of said pair of first container supports, said each of said pair of stop brackets including a first stop element for engaging said first container, and a second stop element for engaging said second container.

6. A refrigerator cabinet according to claim 5, wherein said second container supports are configured to support said second container at a position below said first container supports.

7. A reach-in universal container slide, comprising:

a pair of first container supports, each first container support of said pair of first container supports configured to be mounted on opposite internal sides of a cabinet, said pair of first container supports including first innermost edges which are configured to engage and support a first container of a first size therebetween, said first innermost edges being separated by a first distance;

a pair of second container supports respectively fixedly attached to each of said first container supports, said pair of second container supports having second innermost edges which are configured to support a second container therebetween, said second innermost edges being separated by a second distance greater than said first distance, said second container being of a second size which has a larger dimension than a dimension of said first container, said container slide further comprising stop means disposed at a rear portion of at least one of the first container supports, said stop means for stopping rearward movement of each of the first and second containers, thereby preventing damage to an inner portion of the cabinet, said stop means comprising a first stop element for engaging said first container, and a second stop element for engaging said second container, said first and second stop elements being integral with each other.

* * * * *